US006091337A

United States Patent [19]

Arshad et al.

[11] Patent Number: 6,091,337

[45] Date of Patent: Jul. 18, 2000

[54] HIGH VOLTAGE CONTACT MONITOR WITH BUILT-IN SELF TESTER

[75] Inventors: Mohammad Javaid Arshad, Downers Grove; Alan D. Berger, Winfield, both of Ill.

[73] Assignee: Case Corporation, Racine, Wis.

[21] Appl. No.: 09/268,222

[22] Filed: Mar. 15, 1999

[51] Int. Cl.[7] ..... G08B 21/00

[52] U.S. Cl. ..... 340/662; 340/855.5; 340/856.4; 340/685; 324/326; 324/67; 361/91

[58] Field of Search ..... 340/662, 855.5, 340/855.9, 856.4, 685, 854.6, 853.7, 661; 324/326, 66, 67, 72.5; 361/91

[56] References Cited

U.S. PATENT DOCUMENTS

| | | | |
|---|---|---|---|
| 3,907,136 | 9/1975 | Christides et al. | 214/138 R |
| 3,911,602 | 10/1975 | Trevathan | 37/86 |
| 3,916,298 | 10/1975 | Ulrich | 324/3 |
| 4,228,475 | 10/1980 | Sherwood | 361/47 |
| 4,237,517 | 12/1980 | Myers | 361/239 |
| 4,387,340 | 6/1983 | Peterman | 324/326 |
| 4,398,188 | 8/1983 | Feigal et al. | 340/650 |
| 4,600,356 | 7/1986 | Bridges et al. | 414/694 |
| 4,652,861 | 3/1987 | Domes | 340/359 |
| 4,755,805 | 7/1988 | Chau | 340/662 |
| 5,027,108 | 6/1991 | Gray | 340/662 |
| 5,371,959 | 12/1994 | Ahs | 37/443 |
| 5,469,155 | 11/1995 | Archambeault et al. | 340/853.4 |
| 5,592,092 | 1/1997 | Mechler | 324/326 |
| 5,684,466 | 11/1997 | Keating et al. | 340/662 |
| 5,757,190 | 5/1998 | Mercer | 324/326 |

*Primary Examiner*—Jeffery A. Hofsass
*Assistant Examiner*—Tai T. Nguyen
*Attorney, Agent, or Firm*—Foley & Lardner

[57] ABSTRACT

A sensor system for use on drilling equipment to detect the presence of high voltages during horizontal or vertical drilling and providing an alarm signal corresponding to one of three possibilities: (1) the drilling tool hitting a high voltage line; (2) the drilling tool remaining in contact after hitting the high voltage line; and (3) an exposed or damaged high voltage line in close proximity to the drilling implement. The sensor system detects alternating current, converts the alternating current signal to a pseudo square waveform signal, compares the magnitude of the square waveform signal with a reference voltage, and sounds an alarm if the magnitude of the square waveform signal exceeds the reference voltage. The sensor system also incorporates a self-test circuit which allows an operator to check its functionality before use. The operator can also check the sensor at any time during drilling process.

29 Claims, 3 Drawing Sheets

HIGH VOLTAGE CONTACT MONITOR WITH BUILT-IN SELF TESTER

FIELD OF THE INVENTION

The invention relates generally to the field of high voltage sensors for use on digging implements. In particular, the invention relates to a high voltage sensor that may be used to detect the presence of high voltage cables that are buried underground.

BACKGROUND OF THE INVENTION

Work vehicles, including, but not limited to construction work vehicles such as front loaders, backhoes, drills, and boring equipment, can be configured with sensing equipment, that senses the presence of hazards underground.

Many such sensing devices sense the presence of high voltage cables by sensing high voltages or by sensing voltage gradients in the earth. A single alarm is sounded if the voltages or voltage gradients surpass a predetermined limit. Conventional sensors do not provide multiple alarms corresponding to different conditions of the boring or digging equipment with respect to the high voltage lines and soil conditions. For example, an alarm is only sounded when a voltage predetermined limit is exceeded because the boring or digging equipment has contacted a high voltage line. Using predetermined limits and latching the signal has the disadvantage that false triggering may occur due to a single aberrational voltage spike in the sensing equipment.

Due to the critical need and critical nature of high voltage sensors on drilling equipment, it is important that the sensing equipment be easily tested. Conventional sensing systems require that the sensor be placed in a situation where a high voltage source is present, the sensor is then placed in contact with the source to test the alarm. The clear disadvantage to a system of this type is that it requires a high voltage line to be provided to and exposed to the sensor system.

Thus, it would be desirable to have a high voltage sensor that picks up stray electrical current from a damaged or exposed high voltage line through the earth. Because the earth has a very high impedance to the flow of electricity, it is not desirable to rely on the magnitude of the current sensed by the sensor system. Thus, it would be desirable to have a high voltage sensor that interprets the characteristics of the electrical signal being received by the sensor system. It would also be desirable for an alarm to sound when the drilling tool hits a high voltage line, the drilling tool remains in contact after hitting the high voltage line, and the drilling tool is in close proximity to an exposed or damaged high voltage line.

Because sensor systems dealing with high voltages and large currents are susceptible to damage caused by overload of sensor elements, it would be desirable to have a high voltage invasive sensor with a self-tester that checks the sensor's functionality and the integrity of all of the relevant connections before and during each use. It would be desirable to have a self-tester of this type integrated into the circuitry of the sensor system. Furthermore, it would also be desirable to have a high voltage sensor having rejection circuitry that rejects incoming electrical signals that could possibly cause damage to the sensor electronics.

SUMMARY OF THE INVENTION

The present invention relates to a sensor system for a drilling implement adapted to detect the presence of a high voltage line buried in the earth during drilling. The sensor system includes an alternating current (AC) probe that senses a first electrical signal from the high voltage line when the high voltage line is present. The sensor also includes an AC sensing circuit receiving the first electrical signal from the probe and providing a second electrical signal representative of the first electrical signal. The sensor system also includes an amplifier circuit having an input and an output. The input receives a third electrical signal representative of the second electrical signal and is configured to amplify the third electrical signal and provide a fourth electrical signal representative of the first electrical signal. The fourth electrical signal can be utilized to produce an alarm signal when the high voltage line is present.

The present invention also relates to a method of detecting the presence of high voltage lines underground. The method includes sensing by using an alternating current sensor. The method also includes converting the alternating current sensed to a first electrical signal. The method further includes rectifying the first electrical signal into a second electrical signal. Further still, the method includes providing an alarm when the second electrical signal corresponds to a predetermined characteristic.

Further, the present invention relates to a sensor system adapted to detect the presence of high voltage lines during underground operations. The sensor system includes means for sensing an alternating current underground by using an alternating current sensor. The system also includes means for converting the current sensed into a first electrical signal and means for bidirectional clipping the first electrical signal into a second electrical signal. The sensor system further includes means for providing an alarm when the second electrical signal corresponds to a predetermined characteristic.

BRIEF DESCRIPTION OF THE DRAWINGS

The invention will become more fully understood from the following detailed description, taken in conjunction with the accompanying drawings, wherein like reference numerals refer to like parts, in which.

DETAILED DESCRIPTION OF THE PREFERRED EMBODIMENTS

Figure 1:
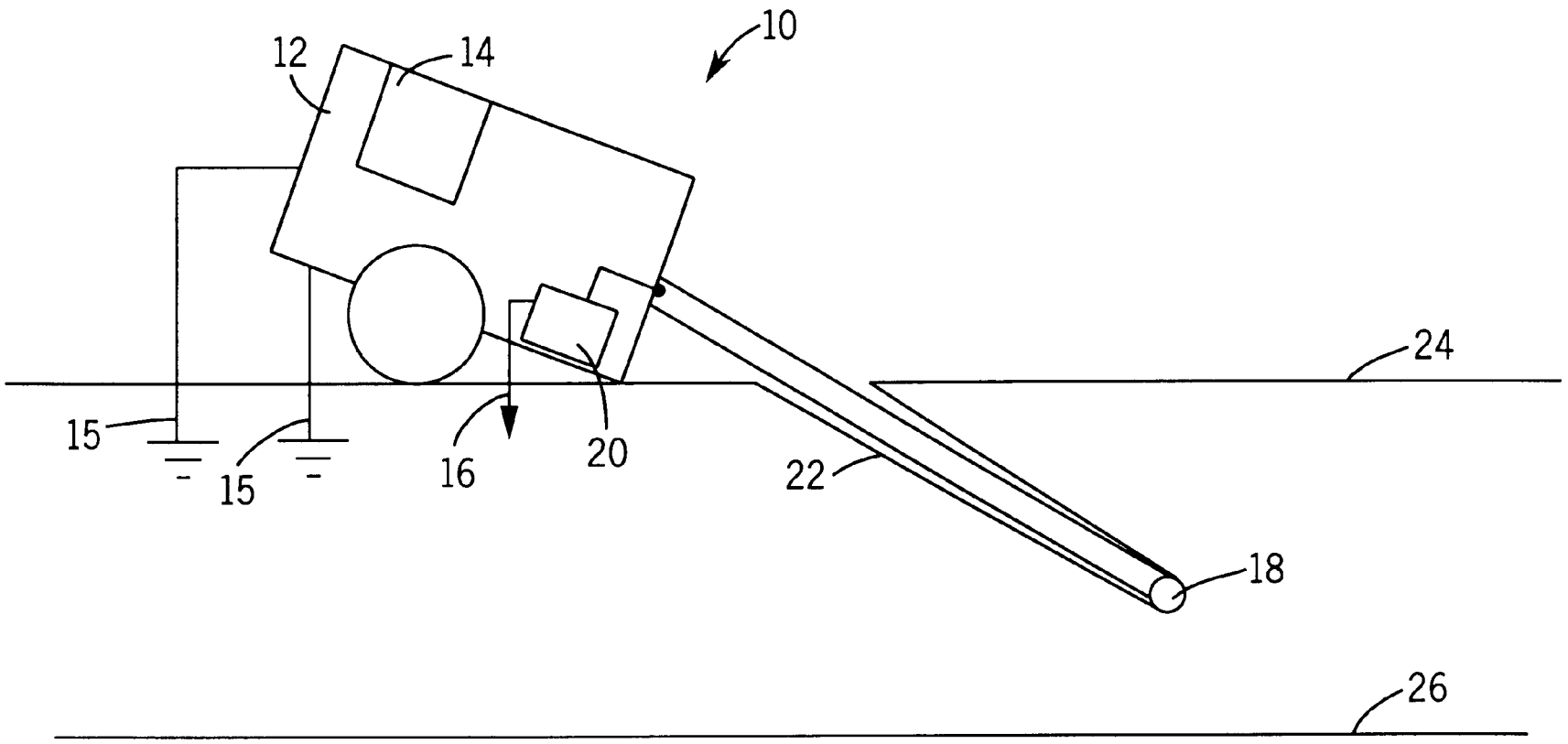
FIG. 1 is a block diagram of a drill showing a high voltage sensor.

Referring to FIG. 1, a horizontal drilling system 10 is depicted, representative of drilling or boring equipment, or any other type of digging or excavating equipment. Drilling system 10 includes a supporting frame 12, a power source 14, a drilling implement or probe 18 (the body of the vehicle, drill bit and probe are electrically transparent) an equipment earth ground 15, an insulated grounding stake 16 and a sensor system 20. In a preferred embodiment, drilling system 10 is a horizontal direction drilling (HDD) machine. The HDD is capable of drilling channels underground up to a mile or more in length and is steerable in four directions. In operation, drilling system 10 bores a hole 22 into the earth 24. Engine 14 drives drilling implement 18 into earth 24 creating hole 22. Probe 18 itself is the drill bit which is attached to the drilling implement. Probe 18 is electrically connected to body sheet metal of the equipment. The equipment may have one or more earth connection for safety. At relatively higher voltages and currents, these earth connections become completely useless. High voltage lines 26 may be buried underneath the surface of earth 24. High voltage lines 26 may have alternating current (AC) voltages anywhere from 75 volts (AC) up to 4,000 volts (AC) or more. Lines 26 typically are insulated lines, however current may escape from lines 26 if the insulation is damaged (cracked or broken) or if the insulation is breached by probe/drilling implement 18. Probe 18 and sensor system 20 are configured to sense the close proximity or the contacting of drilling implement 18 to underground high voltage line 26. Typically the earth will conduct small amounts of current due to the inherent moisture and other conducting materials in the earth.

Figure 2:
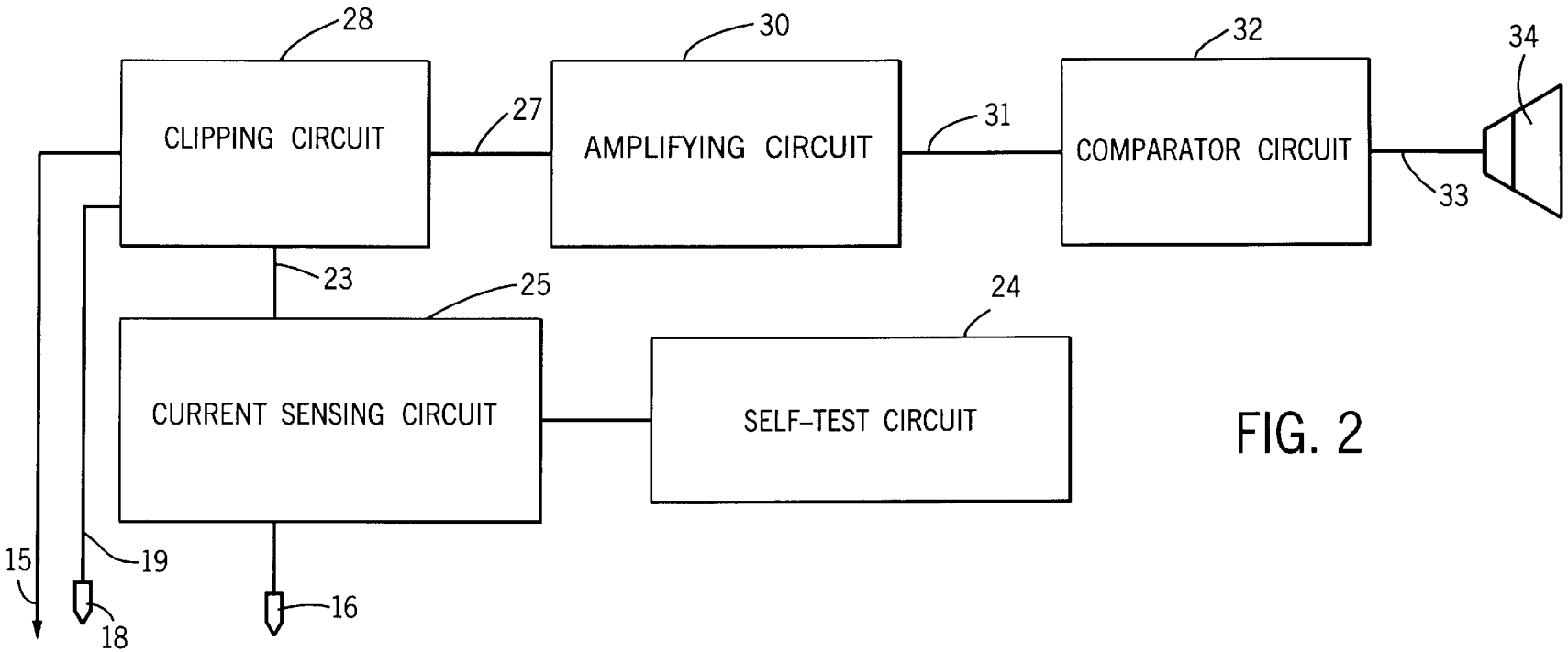
FIG. 2 is a generalized block diagram of the high voltage sensor circuit.

Referring now to FIG. 2, sensor system 20 includes equipment earth ground 15, an insulated grounding stake 16, probe 18, a current sensing circuit 25, a clipping circuit 28, a self-test circuit 29, an amplifier circuit 30, a comparator circuit 32, and an alarm output device, shown as a speaker 34. Sensor system 20 uses the magnitude of the small pulsating alternating loop current between the live wire (i.e., high voltage line 26) and the nearby single-earth connection through a grounding stake 16. The current is picked up by probe 18, communicated to current sensing circuit 25 along connection 19, and returned to the earth by equipment earth ground 15 and also through grounding stake 16. Current sensing circuit 25 communicates a signal along connection 23 to clipping circuit 28. Clipping circuit 28 converts the AC signal communicated along connection 19 into an amplitude-limited or "clipped" sinusoidal signal. The clipped sinusoidal signal is communicated along a connection 27 to amplifying circuit 30, which in a preferred embodiment is a transistor amplifier that avoids noise pick up and also maintains the input characteristic. Amplifying circuit 30 amplifies the amplitude-limited high voltage signals, converting the incoming sinusoidal signal into a substantially square wave signal. (Alternatively, other amplifier circuits known to those of ordinary skill in the art may be used and other preferred signal waveforms may be obtained.) The square wave signal is communicated along a connection 31 to a comparator circuit 32.

Comparator circuit 32 compares the square wave signal to a direct current (DC) reference voltage signal. In a preferred embodiment, if the reference voltage is exceeded by the magnitude of the square wave signal, an alarm signal is communicated over connection 33 to speaker 34. (Alternatively, speaker 34 may be any suitable output device including, but not limited to a visual output on a display screen, an indicator lamp or LED, or an electrical signal communicated to a device controlling drill 10.) The speaker sound is modulated at a rate determined by the frequency of the sensed alternating current. (Conventionally this is at a rate of 60 Hz, however other frequencies such as 50 Hz, especially found in non-U.S. countries, may be sensed.) Any number of alarm sounds corresponding to different signal characteristics input to speaker 34 may be used to represent different drilling conditions (including soil moisture content, e.g.) with regards to high voltage line 26 or a single alarm sound may be used to alert an operator to a hazardous condition. To identify different drilling conditions a signal processing device (not shown) may be used to distinguish between different signal characteristics.

Figure 3:
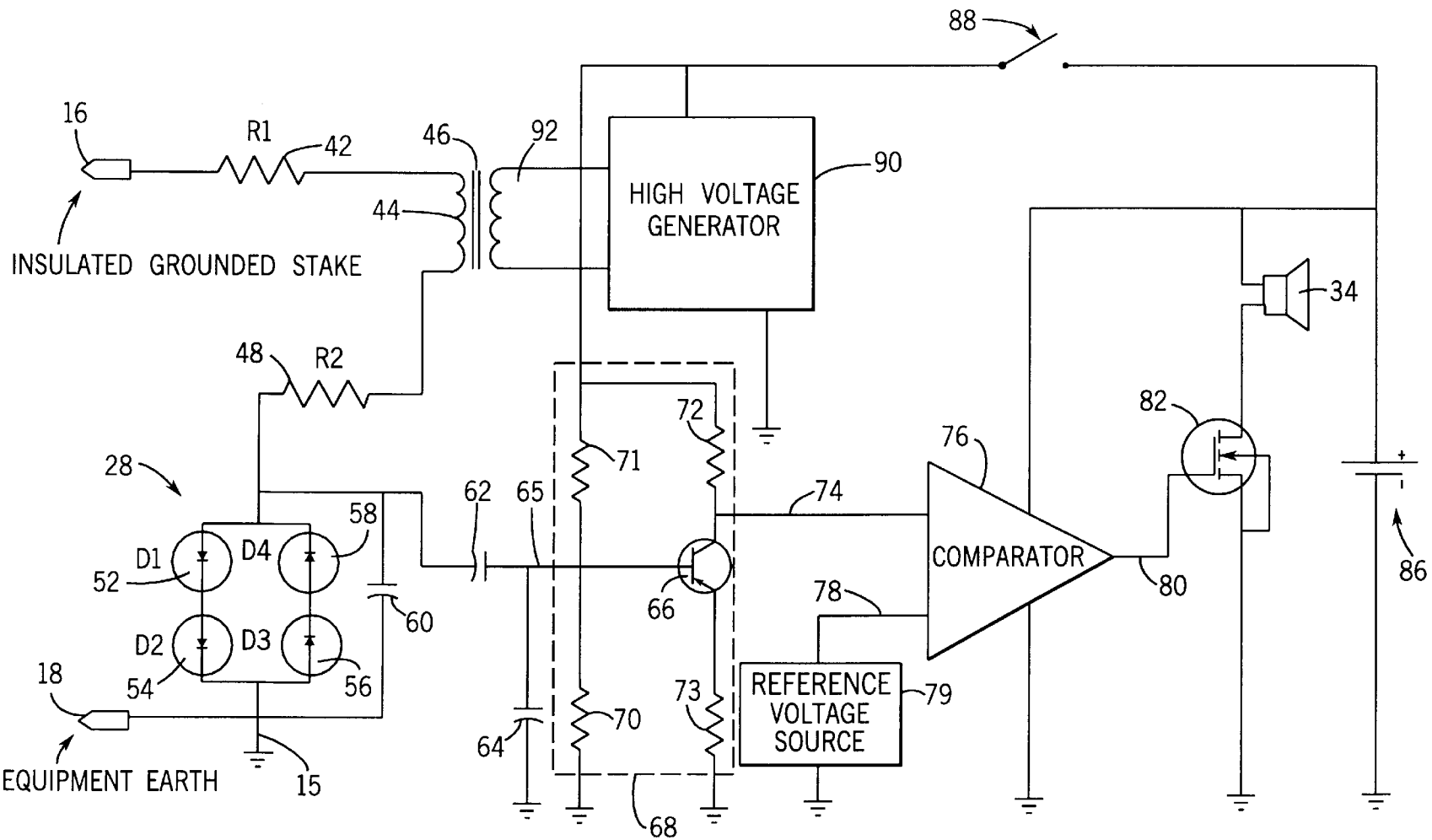
FIG. 3 is a circuit diagram of the high voltage sensor circuit shown in FIG. 2.

Referring now to FIG. 3, probe 18 is configured to pick up very small leakage currents between high voltage line 26, drilling implement 18, and earth 24. These leakage currents are typically on the order of few tens of microamps ($\mu$A), when the drill bit at the end of implement 18 has not contacted high voltage line 26. When insulation is breached on high voltage line 26, probe 18 is configured to pick up currents with a relatively high amperage.

When a current is picked up by probe 18 or drilling implement, the current from probe 18 is communicated through current sensing circuit 25 including a resistor 42, the secondary winding 44 of a transformer 46, and a second resistor 48. The combination of resistor 42, secondary winding 44, and resistor 48 is used to dissipate energy when a high voltage line is contacted directly and large currents flow through probe 18. The series combination of resistors R1 and R2 are preferably on the order of 2–3 Megaohms (MΩ). Alternatively, any combination of resistors having a suitable total magnitude may be used. Furthermore, other energy dissipating devices may replace the series resistors 42 and 48.

After a portion of the incoming energy has been dissipated in resistor 42, secondary winding 44, and resistor 48, the current signal flows to clipping circuit 28. Clipping circuit 28 includes a diode 52, a diode 54, a diode 56, a diode 58, a capacitor 60, a capacitor 62, and a capacitor 64. Diodes 52, 54, 56, and 58 are all voltage-limiting diodes. The series combination of diodes 52 and 54 clip the positive cycle of the incoming sinusoidal signal. In a preferred embodiment, the limiting voltage will be about 1.4 volts, however other limiting voltages may be used without departing from the spirit and scope of the present invention. The main goal of clipping circuit 28 is to prevent subsequent electronics from being exposed to high voltages, that is voltages of the Kilovolt (KV) magnitude. In other words, clipping circuit 28 prevents the base of a transistor 66 from being exposed to more than the limiting voltage of 1.4 volts. Diodes 56 and 58, having an opposing polarity to diodes 52 and 54, are configured in series to clip the negative cycle of the incoming sinusoidal signal. Capacitor 60 acts as a low-pass filter to block out any high-frequency components of the incoming signal. Capacitor 62 is used as a direct current block to prevent any DC component of the sinusoidal signal from entering the base of transistor 66. Further, capacitor 64 is also configured as a filtering element to filter out any undesirable frequency components. Capacitor 60, which acts as a low pass filter also is used to prevent any momentary high voltage spikes from entering the base of transistor 66. Preventing spikes may be important in the case of any static charges entering the system or any high frequency interference caused by devices like cellular phones which could possibly trigger the unit.

The clipped sinusoidal signal 65 is communicated to an amplifying circuit 30 (FIG. 2), shown as a class A single ended current amplifier circuit 68 (FIG. 3). Single ended current amplifier circuit 68 includes a transistor 66, such as a bipolar junction transistor or any type of suitable general purpose transistor. Single ended current amplifier circuit 68 also includes resistors 70, 71, 72, and 73. The configuration of resistors 70, 71, 72, 73, and transistor 66 forms a standard class A transistor amplifier which is well known to those of ordinary skill in the art. Single ended current amplifier circuit 68 is configured to be operated by a single power supply 86, wherein this configuration inherently amplifies the amplitude-limited high voltage signals. However, any of a number of other transistor amplifiers may be applied in place of single ended current amplifier circuit 68, or any of a number of other amplifying devices may be substituted for single ended current amplifier circuit 68 without departing from the spirit and scope of the present invention.

Single ended current amplifier circuit 68 has an output signal 74, associated therewith. Output signal 74 communicates an amplified and slightly modified version of signal 65. Output signal 74 is substantially a square wave signal. The square wave is communicated to a comparator 76. Comparator 76 compares the maximum values of square wave 74 with a DC reference voltage 78 generated by a reference voltage source 79. DC reference voltage 78 may be, in a preferred embodiment 7 or 8 volts, however any suitable DC reference voltage may be used without departing from the spirit and scope of the present invention. Comparator 76 compares output signal 74 and DC reference voltage 78. If output signal 74 moves beyond the magnitude of reference voltage 78, comparator 76 outputs a signal along line 80 which activates a transistor 82. Transistor 82 may be a field effect transistor (FET) switch, a junction field effect transistor (JFET), or a depletion-mode metal-oxide semiconductor field effect transistor (MOSFET) or any other suitable switching device. When transistor 82 is activated by a signal communicated along line 80, a buzzer or any other suitable alarm is output at speaker 34. Speaker 34 may be replaced by any other suitable output device including but not limited to an indicator lamp or a LED, a CRT display signal, or any other suitable alarm signals. In a preferred embodiment of the present invention, buzzer 34 is modulated at the same frequency as the signal sensed by probe 18. Comparator 76 can generate a limited range of variable duty cycle square waves corresponding to at least two distinct sounds, each sound being indicative of earth conductivity.

In a preferred embodiment of the present invention, self-test circuit 29 is included in the electronics of sensor system 20. The self-test circuit includes power source 86 (which also powers comparator 76 and transistor 82), a switch 88, a high voltage generator 90, and transformer 46. Transformer 46 includes secondary windings 44, and primary windings 92 electrically coupled to high voltage generator 90. Power source 86 is, in a preferred embodiment, the drilling system battery. When an operator wishes to test the sensor circuit, switch 88 is manually closed causing a current to flow to high voltage generator 90 and thereby activating high voltage generator 90. High voltage generator 90 induces a current to flow between grounding stake 16 and probe 18 and/or between grounding stake 16 and ground 15. In operation, when switch 88 is closed, high voltage generator 90 produces a high AC voltage across primary windings 92 of transformer 46 which induces an AC voltage (e.g., 110 $V_{AC}$) across secondary windings 44 of current sensing circuit 25. Thus, the actuation of switch 88 induces an electrical signal in current sensing circuit 25 which is similar to the electrical signal which would be induced when probe 18 is used to detect the presence of high voltage lines 26 during actual digging operations. In a preferred embodiment, however any other suitable alternating voltage may be used as long as it has the capability of triggering the alarm. Once a current is generated in secondary windings 44, the sensor circuit operates the same as if probe 18 had contacted a high voltage line. Thus, if the circuit is operating correctly an alarm should be produced.

Although only a few exemplary embodiments of this invention have been described above, those skilled in the art will readily appreciate that many modifications are possible in the exemplary embodiments without materially departing from the novel teachings and advantages of this invention. As is readily indicated, the invention can be employed in a variety of ways and on a variety of drilling and excavating equipment. Further, the precise circuitry disclosed may be varied insofar as it continues to accomplish functions related with the high voltage sensor. Further, the output signals created by the signal processor may be any of a variety of alarm signals. Accordingly, all such modifications are intended to be included within the scope of the invention as defined in the following claims. Other substitutions, modifications, changes, and omissions may be made in the design, operating conditions and arrangement of the preferred and alternative embodiments without departing from the spirit of the invention as expressed in the appended claims.

What is claimed is:

1. A sensor system for a drilling implement adapted to detect the presence of a high voltage line buried in the earth during drilling, the sensor system comprising:

an alternating current (AC) probe, sensing a first electrical signal from the high voltage line when the high voltage line is present;

an AC sensing circuit, receiving the first electrical signal from the AC probe and providing a second electrical signal representative of the first electrical signal; and an alternating current (AC) coupled amplifier circuit having an input and an output, the input receiving a third electrical signal representative of the second electrical signal and configured to amplify the third electrical signal and provide a fourth electrical signal representative of the first electrical signal, wherein the fourth electrical signal produces an alarm signal when the high voltage line is present.

2. A sensor system for a drilling implement adapted to detect the presence of a high voltage line buried in the earth during drilling, the sensor system comprising:

an alternating current (AC) probe, sensing a first electrical signal from the high voltage line when the high voltage line is present;

an AC sensing circuit, receiving the first electrical signal from the AC probe and providing a second electrical signal representative of the first electrical signal; and an amplifier circuit having an input and an output, the input receiving a third electrical signal representative of the second electrical signal and configured to amplify the third electrical signal and provide a fourth electrical signal representative of the first electrical signal, wherein the fourth electrical signal produces an alarm signal when the high voltage line is present, the third electrical signal is substantially sinusoidal and the fourth electrical signal provided by the amplifier circuit is substantially a square wave.

3. The sensor system according to claim 2 wherein the amplifier circuit includes an amplifier configured to be operated by a single power supply.

4. The sensor system according to claim 2 further comprising a comparator circuit, the comparator circuit having a first input, a second input, and an output, the first input receiving a fifth electrical signal representative of the fourth electrical signal, the second input receiving a reference electrical signal, and the output providing a sixth electrical signal representative of the first electrical signal.

5. The sensor system according to claim 4 wherein the comparator circuit provides the sixth electrical signal to produce an alarm corresponding to at least one of the drilling implement striking the high voltage line, the drilling implement remaining in contact with the high voltage line after striking the high voltage line, and the high voltage line being exposed and in close proximity to the drilling implement.

6. The sensor system according to claim 2 further comprising a testing circuit coupled to the AC sensing circuit.

7. The sensor system according to claim 6 wherein the testing circuit is configured to induce a self-test electrical signal in the AC sensing circuit such that the fourth electrical signal produces the alarm signal.

8. The sensor system according to claim 7 wherein the testing circuit includes a voltage generator and a transformer coupled to the voltage generator, the transformer also being coupled to the AC sensing circuit to induce the self-test electrical signal when the voltage generator is activated.

9. The sensor system according to claim 2 wherein the first electrical signal is less than 100 microamps.

10. A sensor system for a drilling implement adapted to detect the presence of a high voltage line buried in the earth during drilling, the sensor system comprising:

an alternating current (AC) probe, sensing a first electrical signal from the high voltage line when the high voltage line is present;

an AC sensing circuit, receiving the first electrical signal from the AC probe and providing a second electrical signal representative of the first electrical signal;

an amplifier circuit having an input and an output, the input receiving a third electrical signal representative of the second electrical signal and configured to amplify the third electrical signal and provide a fourth electrical signal representative of the first electrical signal; and a clipping circuit having an input and an output, the input receiving the second electrical signal and configured to amplitude limit the second electrical signal and provide the third electrical signal representative of the amplitude-limited second electrical signal wherein the fourth electrical signal produces an alarm signal when the high voltage line is present.

11. The sensor system according to claim 10 wherein the clipping circuit includes at least one diode.

12. The sensor system according to claim 11 wherein the clipping circuit includes a parallel circuit of diodes having at least two branches, the diodes being arranged with opposing polarity on two of the branches.

13. A method of detecting the presence of high voltage lines underground, the method comprising:

sensing an alternating current underground by using an alternating current sensor;

converting the sensed alternating current to a first electrical signal;

rectifying the first electrical signal into a second electrical signal including utilizing an alternating current (AC) coupled amplifier; and providing an alarm when the second electrical signal corresponds to a predetermined characteristic.

14. A method of detecting the presence of high voltage lines underground, the method comprising:

sensing an alternating current underground by using an alternating current sensor;

converting the sensed alternating current to a first electrical signal;

rectifying the first electrical signal into a second electrical signal; and providing an alarm when the second electrical signal corresponds to a predetermined characteristic, wherein the first electrical signal is a substantially amplitude-limited sinusoidal signal.

15. The method according to claim 14 wherein the second electrical signal is a substantially square wave signal.

16. The method according to claim 14 wherein the characteristic of the second electrical signal is determined by a comparator.

17. The method of claim 14 wherein the rectifying step is performed by an amplifier circuit.

18. A sensor system adapted to detect the presence of high voltage lines during underground operations, the sensor system comprising:

means for sensing an alternating current underground by using an alternating current sensor;

means for converting the current sensed to a first electrical signal;

means for amplifying the first electrical signal into a second electrical signal including an alternating current (AC) coupled amplifier; and means for providing an alarm when the second electrical signal corresponds to a predetermined characteristic.

19. The sensor system of claim 18 further comprising a means for testing the sensor system that is an integrated branch of the sensor system.

20. A sensor system adapted to detect the presence of high voltage lines during underground operations, the sensor system comprising:

means for sensing an alternating current underground by using an alternating current sensor;

means for converting the current sensed to a first electrical signal;

means for amplifying the first electrical signal into a second electrical signal; and means for providing an alarm when the second electrical signal corresponds to a predetermined characteristic, wherein the first electrical signal is a substantially amplitude-limited sinusoidal signal.

21. The method according to claim 20 wherein the second electrical signal is substantially a square wave signal.

22. The method according to claim 21 wherein the characteristic of the second electrical signal is determined by a comparator.

23. The method of claim 20 wherein the amplifying step is performed by a transistor amplifier circuit.

24. A sensor system for earth-working equipment adapted to detect the nearby presence of a high voltage line buried in the earth during earth moving, the sensor system comprising:

an alternating current (AC) contact, sensing a first electrical signal from the high voltage line when the high voltage line is substantially present;

an AC sensing circuit, receiving the first electrical signal from the AC contact and providing a second electrical signal representative of the first electrical signal; and a current amplifier circuit having an input and an output, the input receiving a third electrical signal representative of the second electrical signal and configured to amplify the third electrical signal and provide a fourth electrical signal representative of the first electrical signal, wherein the fourth electrical signal produces an alarm signal substantially while the high voltage line is substantially present and cancels the alarm signal substantially when the voltage line is not substantially present.

25. The sensor system of claim 24 wherein the current amplifier circuit includes a single-ended current amplifier.

26. The sensor system of claim 24 wherein the alternating current contact at least partially includes the earth-working equipment.

27. The sensor system of claim 24 further comprising a self-test circuit.

28. The sensor system of claim 27 wherein the self-test circuit is configured to provide a current in the earth.

29. The sensor system of claim 27 wherein the self-test circuit is configured to test the condition of the soil of the earth.

* * * * *